US005455653A

United States Patent [19]

Shimamura et al.

[11] Patent Number: 5,455,653

[45] Date of Patent: Oct. 3, 1995

[54] PHOTOGRAPHIC PROCESSING MACHINE

[75] Inventors: Yasunobu Shimamura; Shigeru Masuda; Shinji Fukushima; Masayuki Kojima; Mitsuji Kawashima; Hisashi Negoro; Yutaka Kiyonaga, all of Wakayama, Japan

[73] Assignee: Noritsu Koki Co., Ltd., Wakayama, Japan

[21] Appl. No.: 310,082

[22] Filed: Sep. 22, 1994

[30] Foreign Application Priority Data

| | | | |
|---|---|---|---|
| Sep. 24, 1993 | [JP] | Japan | 5-238288 |
| Sep. 24, 1993 | [JP] | Japan | 5-238336 |
| Jun. 21, 1994 | [JP] | Japan | 6-138864 |

[51] Int. Cl.[6] ..... G03D 3/08

[52] U.S. Cl. ..... 354/319; 354/321

[58] Field of Search ..... 354/313, 317–324, 354/337–340; 355/27–29; 326/190, 199, 119, 118, 113

[56] References Cited

U.S. PATENT DOCUMENTS

| | | | |
|---|---|---|---|
| 4,126,391 | 11/1978 | Nishimoto | 354/322 X |
| 4,843,490 | 6/1989 | Huber et al. | 354/313 X |
| 5,041,853 | 8/1991 | Kiejzik | 355/317 X |
| 5,231,439 | 7/1993 | Takahashi et al. | 354/313 |
| 5,317,358 | 5/1994 | Kawada | 354/319 |

FOREIGN PATENT DOCUMENTS

| | | |
|---|---|---|
| 0595204 | 5/1994 | European Pat. Off. . |
| 3623084 | 1/1987 | Germany . |
| 4110642 | 10/1992 | Germany . |

*Primary Examiner*—D. Rutledge
*Attorney, Agent, or Firm*—Wenderoth, Lind & Ponack

[57] ABSTRACT

The films are developed and printed continuously and automatically even if the film feed direction in the film processor and the one in the printer are not in the same vertical plane. A film stocking unit is provided downstream of the film driving unit. The film stocking unit is movable to a position aligned with the film feed path extending to the printing unit. This increases the freedom or flexibility in arranging the film processor and the printer.

2 Claims, 19 Drawing Sheets

PHOTOGRAPHIC PROCESSING MACHINE

BACKGROUND OF THE INVENTION

This invention relates to a photographic processing machine for automatically developing and drying film, printing images on films onto photographic paper, and developing and drying the photographic paper.

As shown in FIGS. 18 and 19, this type of photographic processing machine has a film developing unit A comprising a plurality of treating tanks, a film drying unit B, a printing unit C, a printed paper developing unit D having a plurality of treating tanks, and a printed paper drying unit E. Films F are fed through the units A, B and C. Web of photographic paper P is fed through the units C, D and E. While feeding films and photographic paper, the films are developed and dried and the images thereon are printed onto the photographic paper. The thus printed photographic paper is developed and dried. These steps are all carried out automatically.

In the photographic art, the film developing unit A and film drying unit B are usually referred to comprehensively as a film processor, while the printing unit C, printed paper developing unit D and printed paper drying unit E are comprehensively called a printer.

In such a photographic processing device, since the film is in the form of a tape, it can not be turned in the same horizontal plane. For this reason, the film feed path G extending from the film drying unit B to the printing unit C is located right over the film drying unit B (FIG. 18), or it extends straight ahead from the unit B (FIG. 19).

With either of the above arrangements, the device is inevitably elongated in a vertical direction or in a longitudinal direction. In recent years, photographic processing device of this kind are installed in small places. In view of the restriction resulting therefrom, there is an increased demand for more compact photographic processing devices.

An object of the present invention is to provide a photographic processing device in which the films can be developed and printed continuously and automatically even if the film feed direction in the film processor and that in the printer are not in the same vertical plane.

SUMMARY OF THE INVENTION

In order to solve the above problems, according to the present invention, the film developing unit and the film drying unit are arranged along a straight line from a film inlet formed in the film developing unit, a film feed path extending to the printing unit is provided in a different direction from the straight line that extends through the film developing unit and the film drying unit, and a film stocking unit is provided downstream of the film drying unit, the film stocking unit being movable to a position aligned with the film feed path extending to the printing unit.

in the arrangement in which a leader is attached to the leading end of the film, means for separating the leader from the film is provided upstream of the printing unit.

In this photographic processing device according to this invention, the film is developed and dried in the film processor and then fed to the film stocking unit. After the feed of the film is complete, the film stocking unit is moved to the film feed path which extends to the printing unit until it is aligned with the film feed path. The film in the film stocking unit is fed to the printing unit in the printer for printing, developing and drying. The film stocking unit is moved back to the film processor after the film has been fed out therefrom.

If leaders are attached to the leading end of films, they are cut apart from the films at a portion upstream of the printing unit and then fed further.

In this invention, the films are developed and printed continuously and automatically even if the film feed direction in the film processor and the one in the printer are not in the same vertical plane. Thus, the film processor and the printer can be arranged more freely according to the given conditions. Also, the entire size can be advantageously reduced.

Other features and objects of the present invention will become apparent from the following description made with reference to the accompanying drawings, in which:

BRIEF DESCRIPTION OF THE INVENTION

Figure 7A:
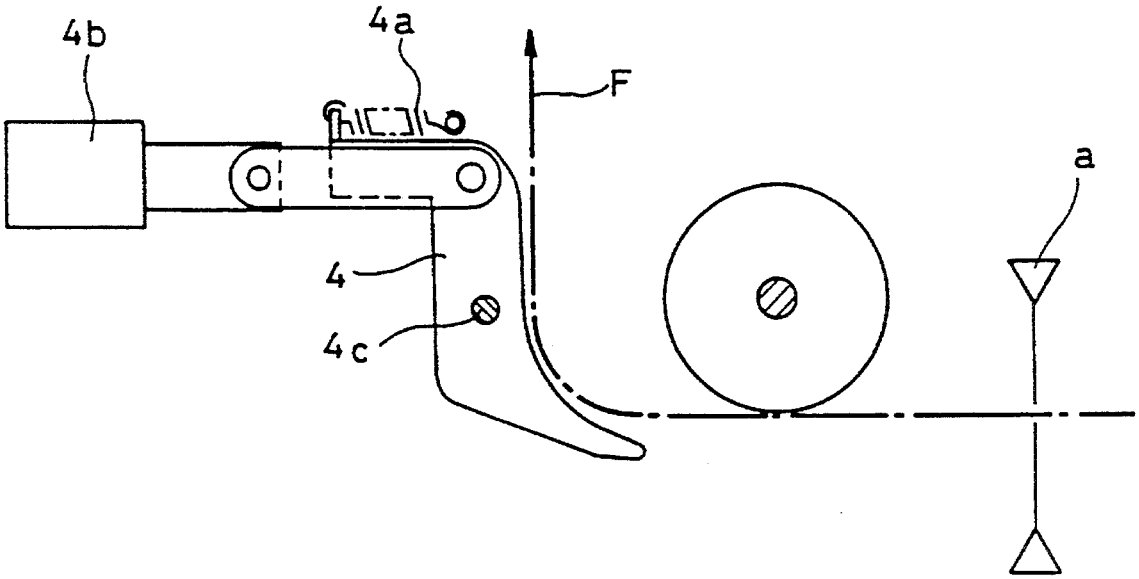
Figure 7B:
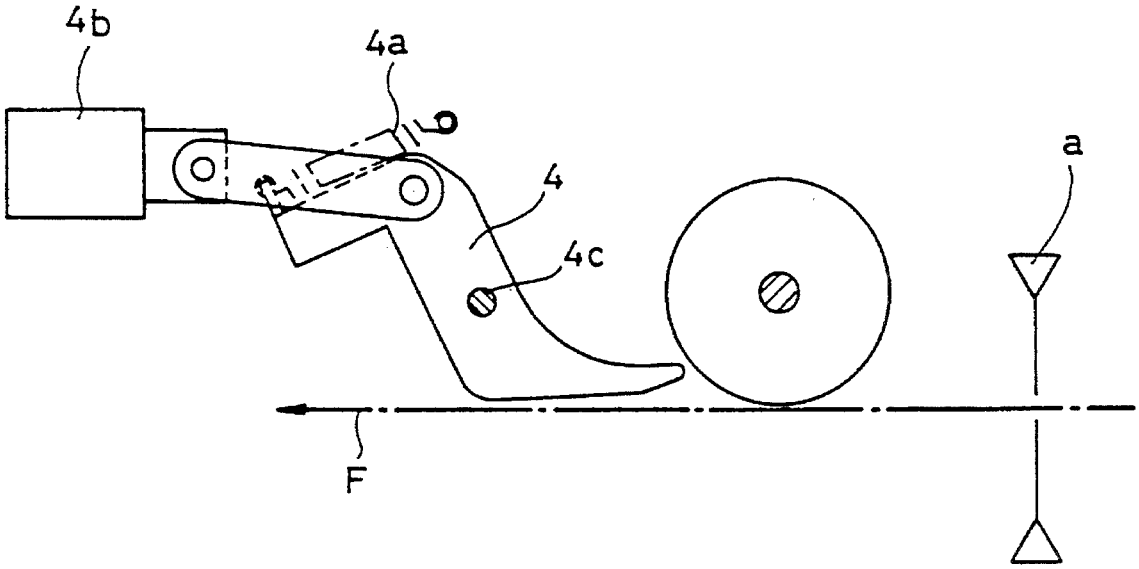
Figure 8:
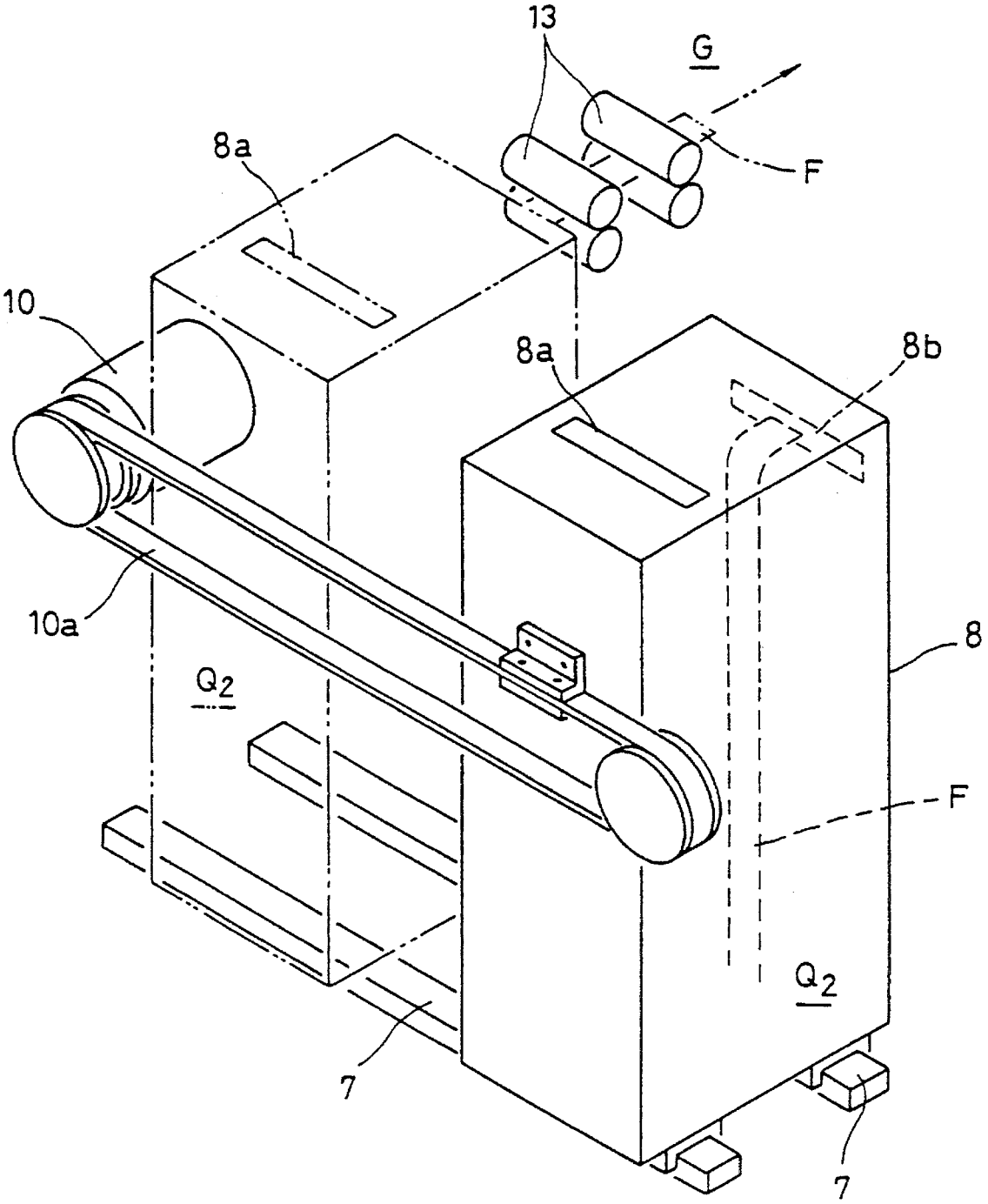
Figure 9:
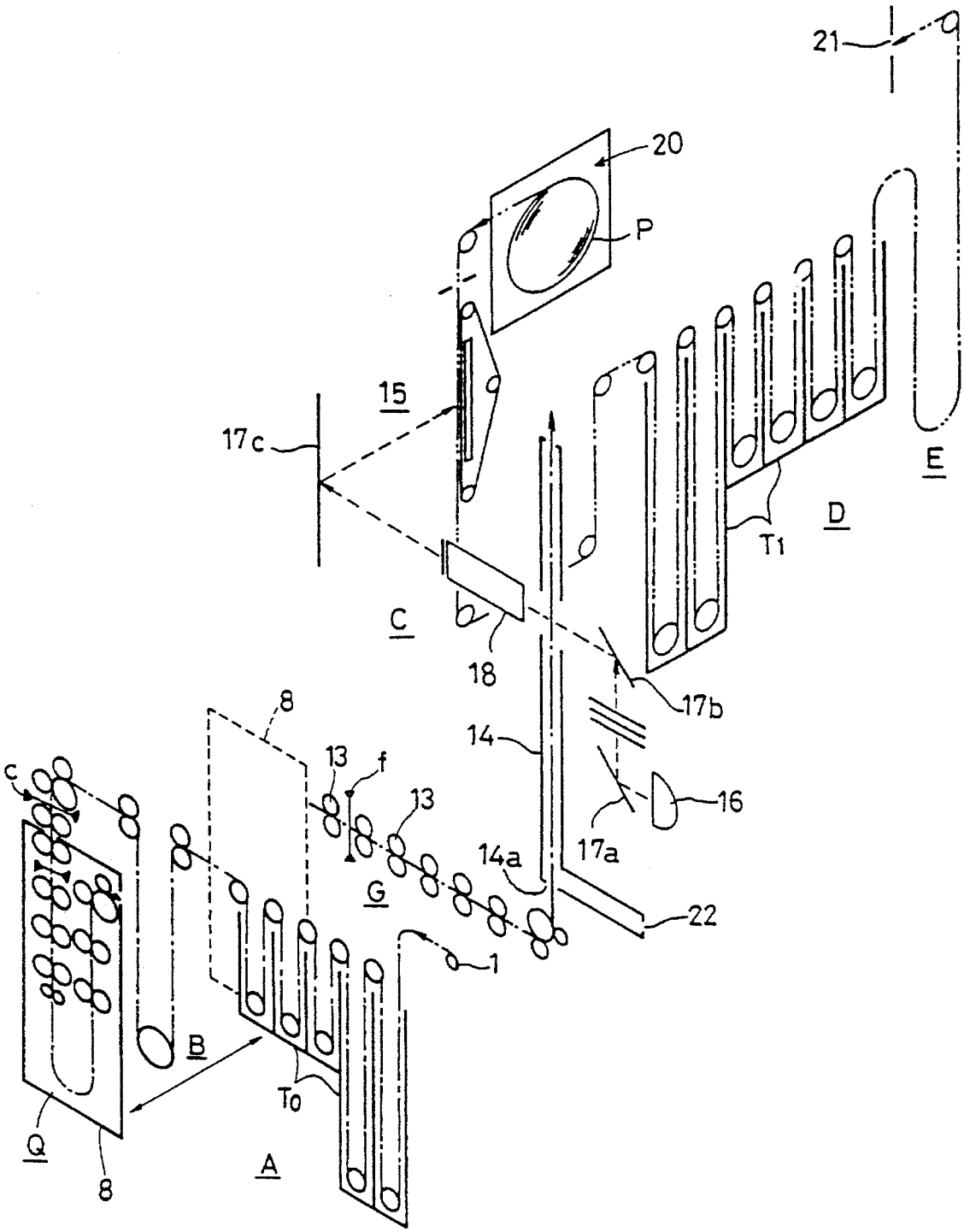
Figure 10:
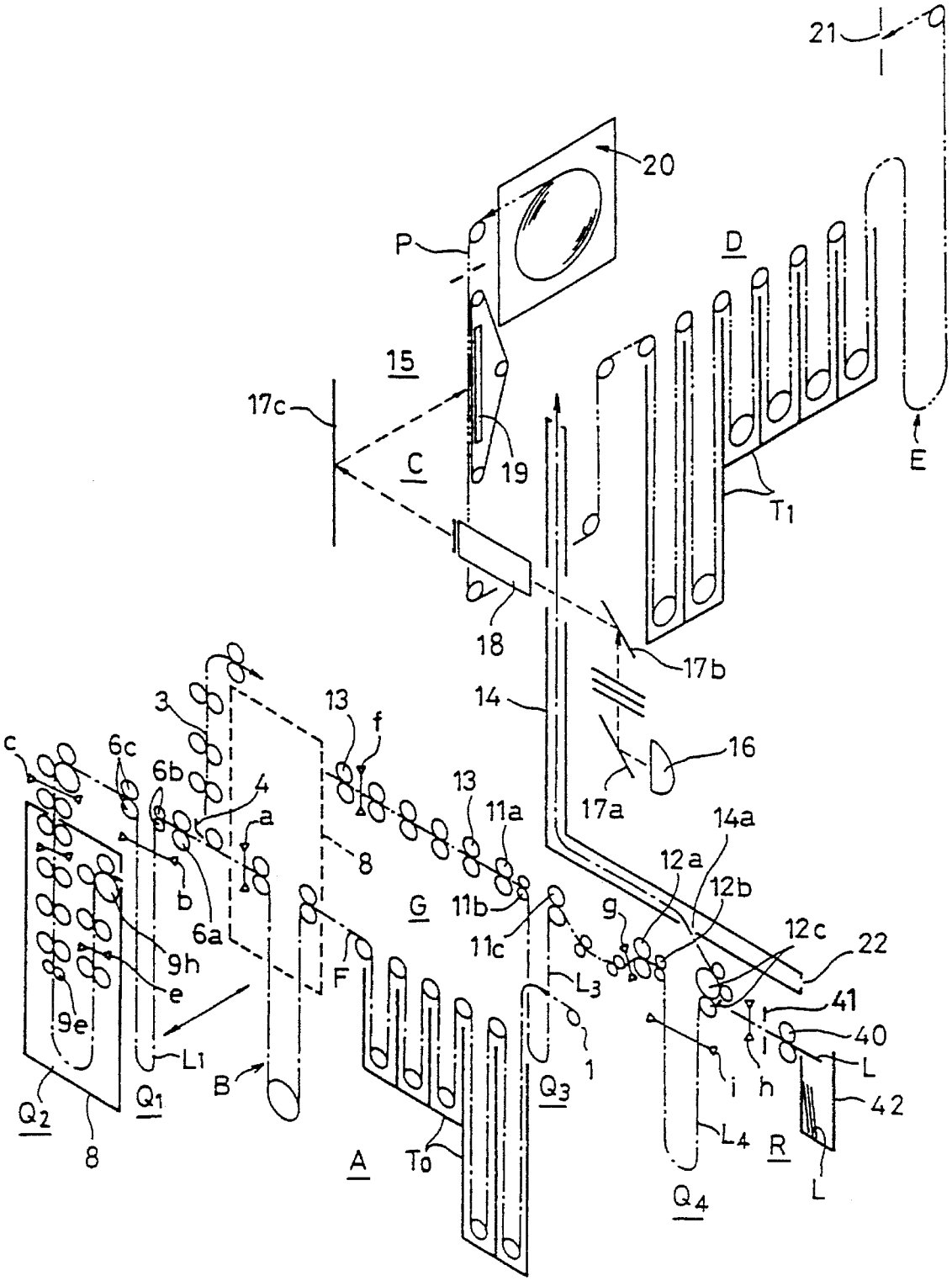
Figure 11:
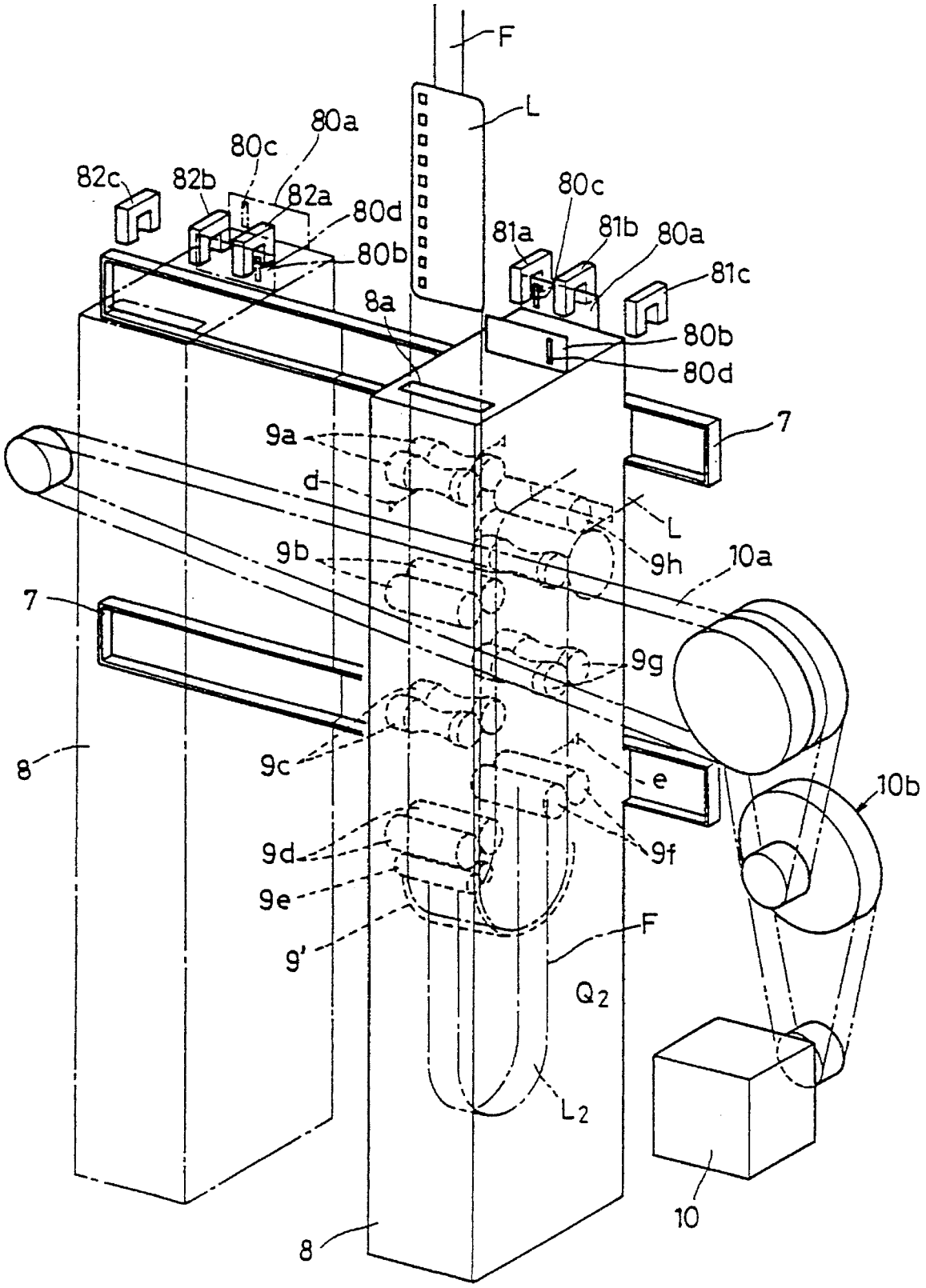
Figure 12:
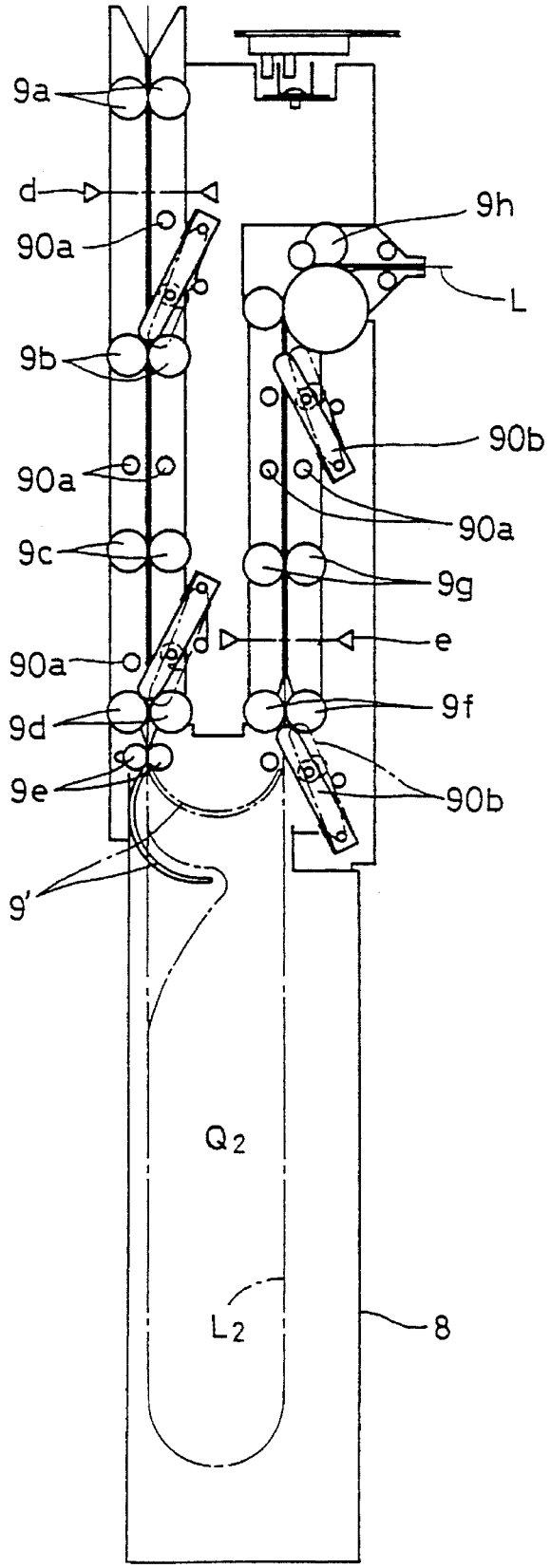
Figure 13:
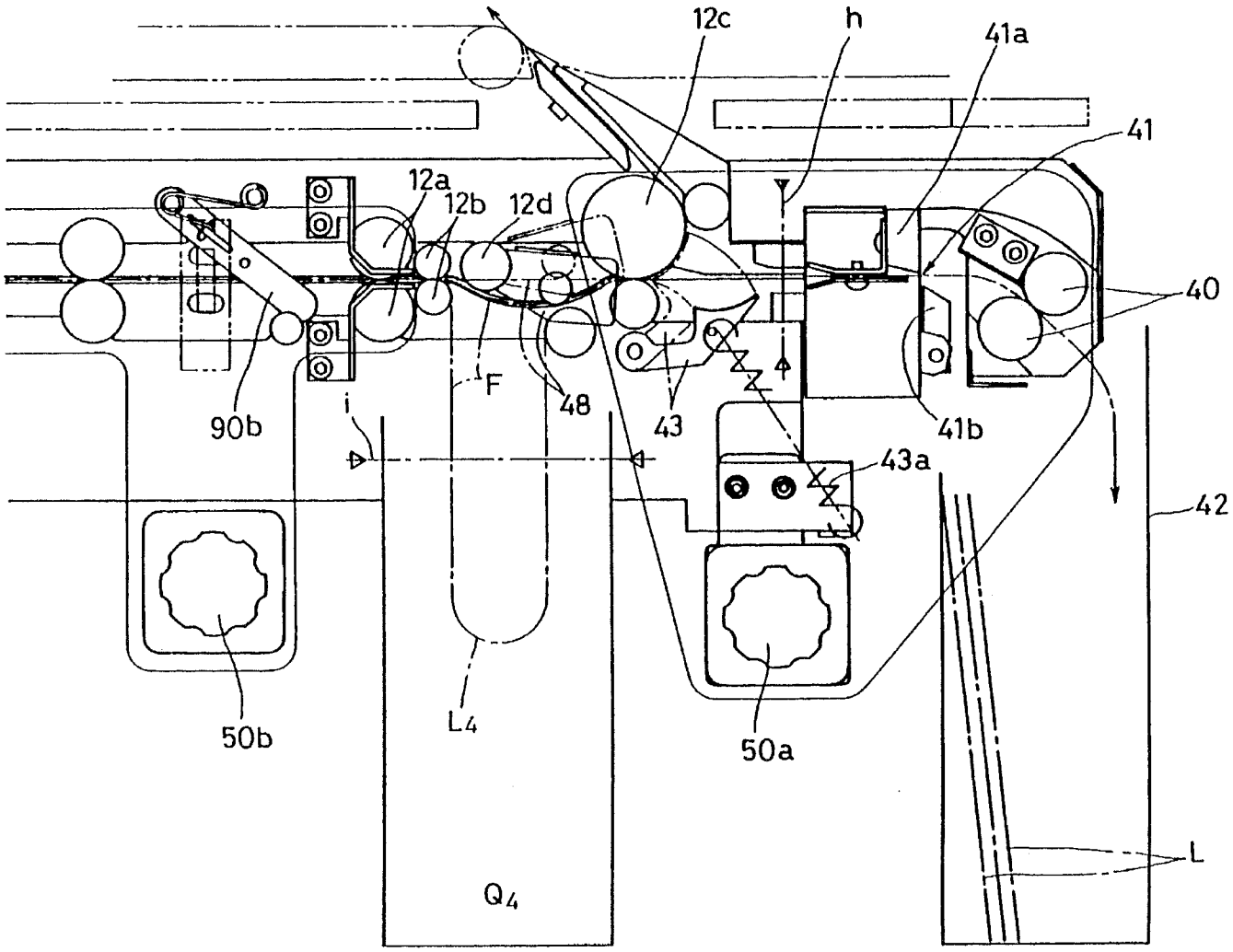
Figure 14B:
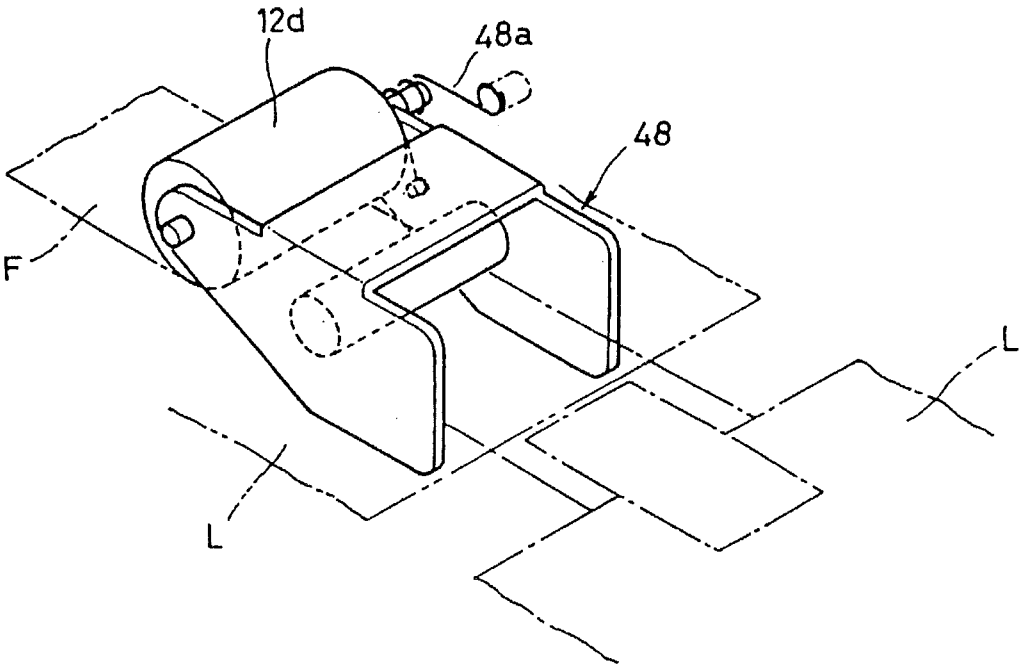
Figure 14A:
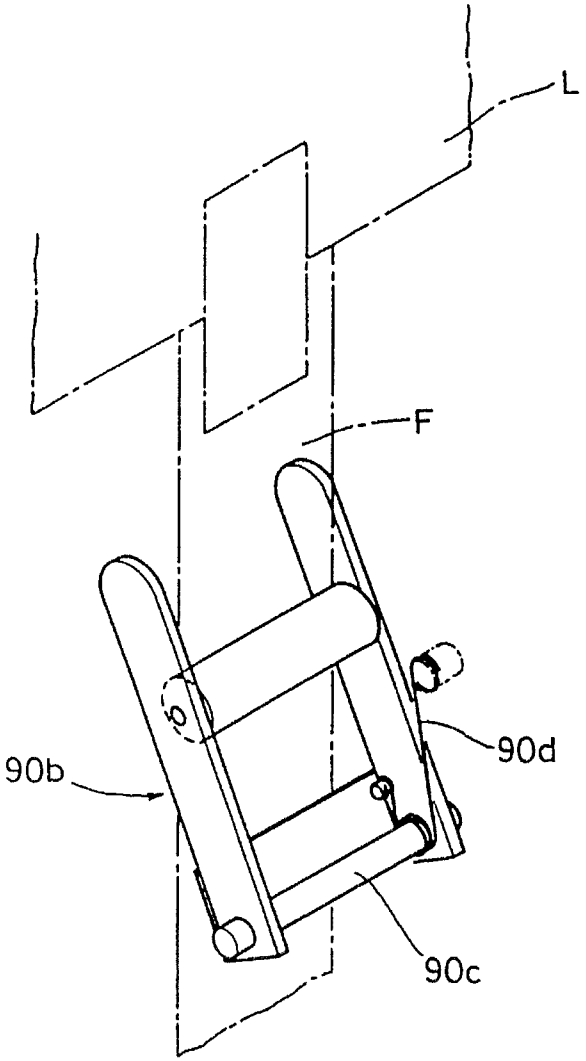
Figure 16:
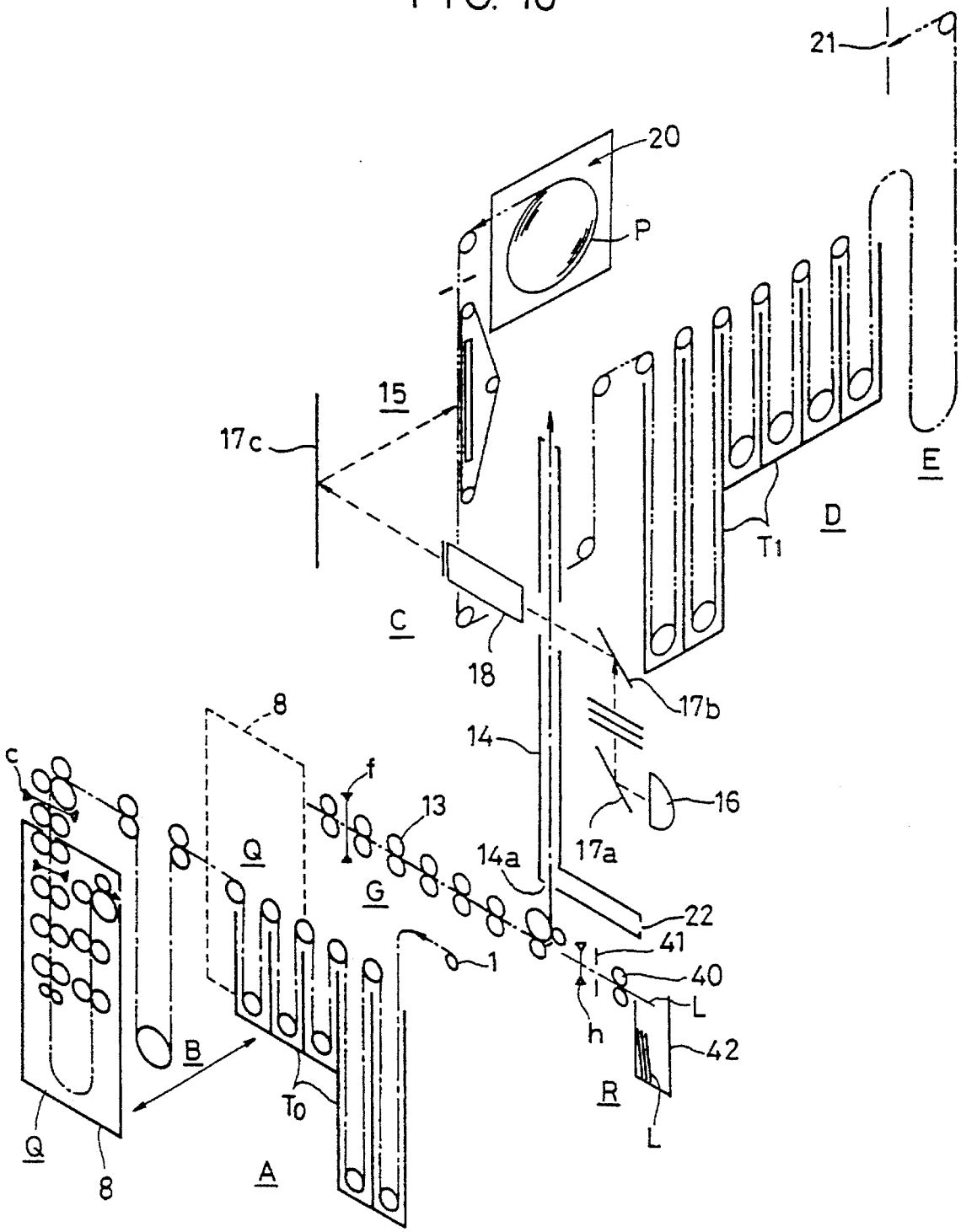
Figure 17:
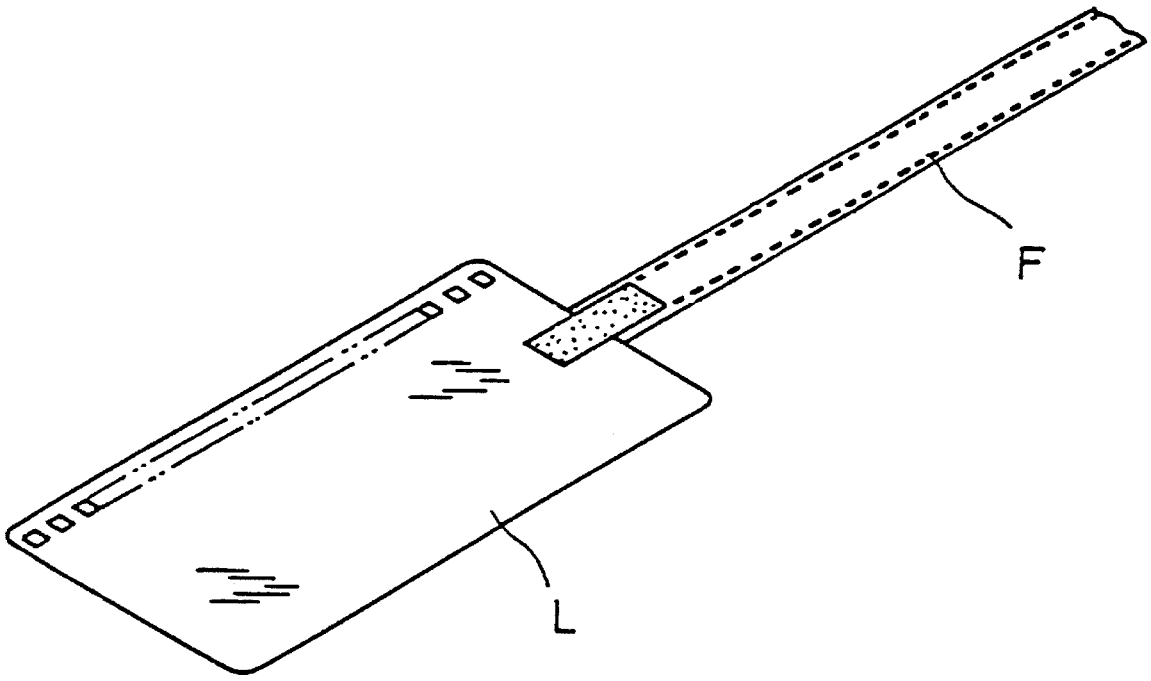
Figure 18:
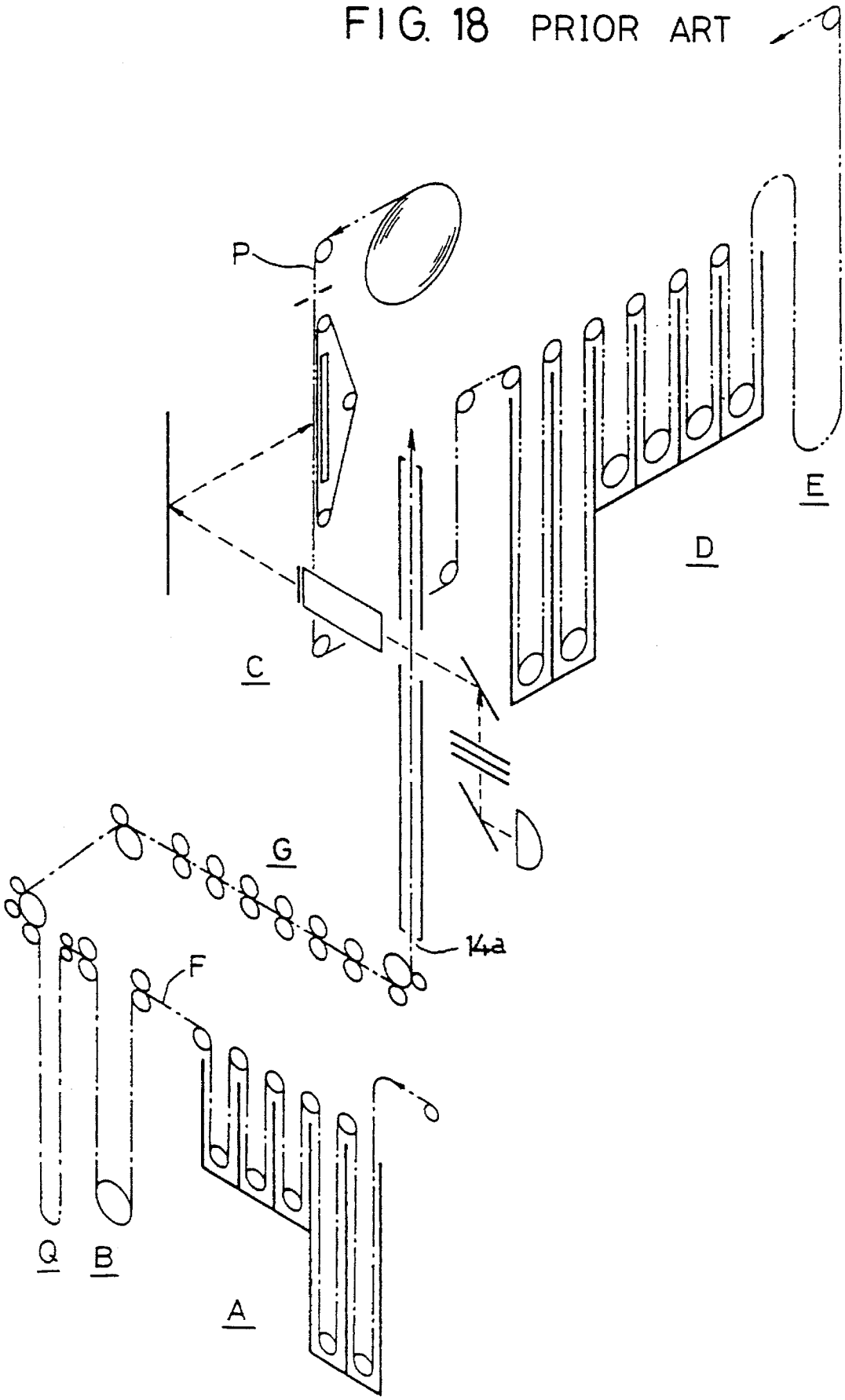
FIG. 18 PRIOR ART

FIG. is a perspective view of a portion of the same;

FIGS. 7A and 7B are views that show the operation of the same;

FIG. 8 is a schematic perspective view of a portion of the same;

FIG. 9 is a schematic perspective view of another embodiment;

FIG. 10 is a schematic perspective view of another embodiment;

FIG. 11 is a partial perspective view of the same;

FIG. 12 is a schematic front view of a portion of the same;

FIG. 13 is a schematic front view of a portion of the same;

FIGS. 14A and 14B are perspective views of the film guide of the same;

FIGS. 15A–15D are views explaining the operation of the same;

FIG. 16 is a schematic perspective view of another embodiment;

FIG. 17 is a partial perspective view of a film having a leader attached thereto;

FIG. 18 is a schematic perspective view of the prior art; and

Figure 19:
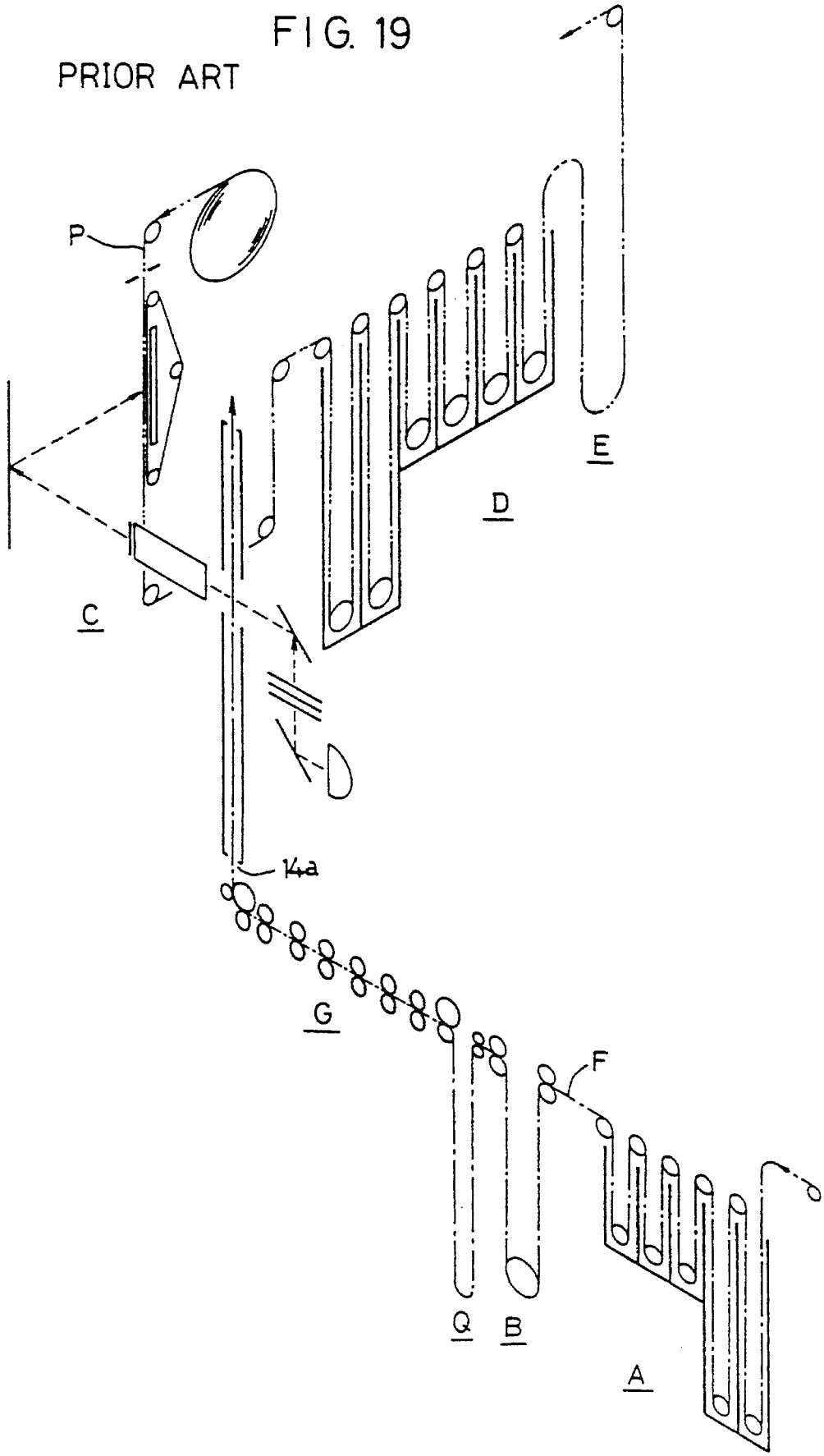
FIG. 19 PRIOR ART

FIG. 19 is a schematic perspective view of the prior art.

DETAILED DESCRIPTION OF THE PREFERRED EMBODIMENT

Figure 5:
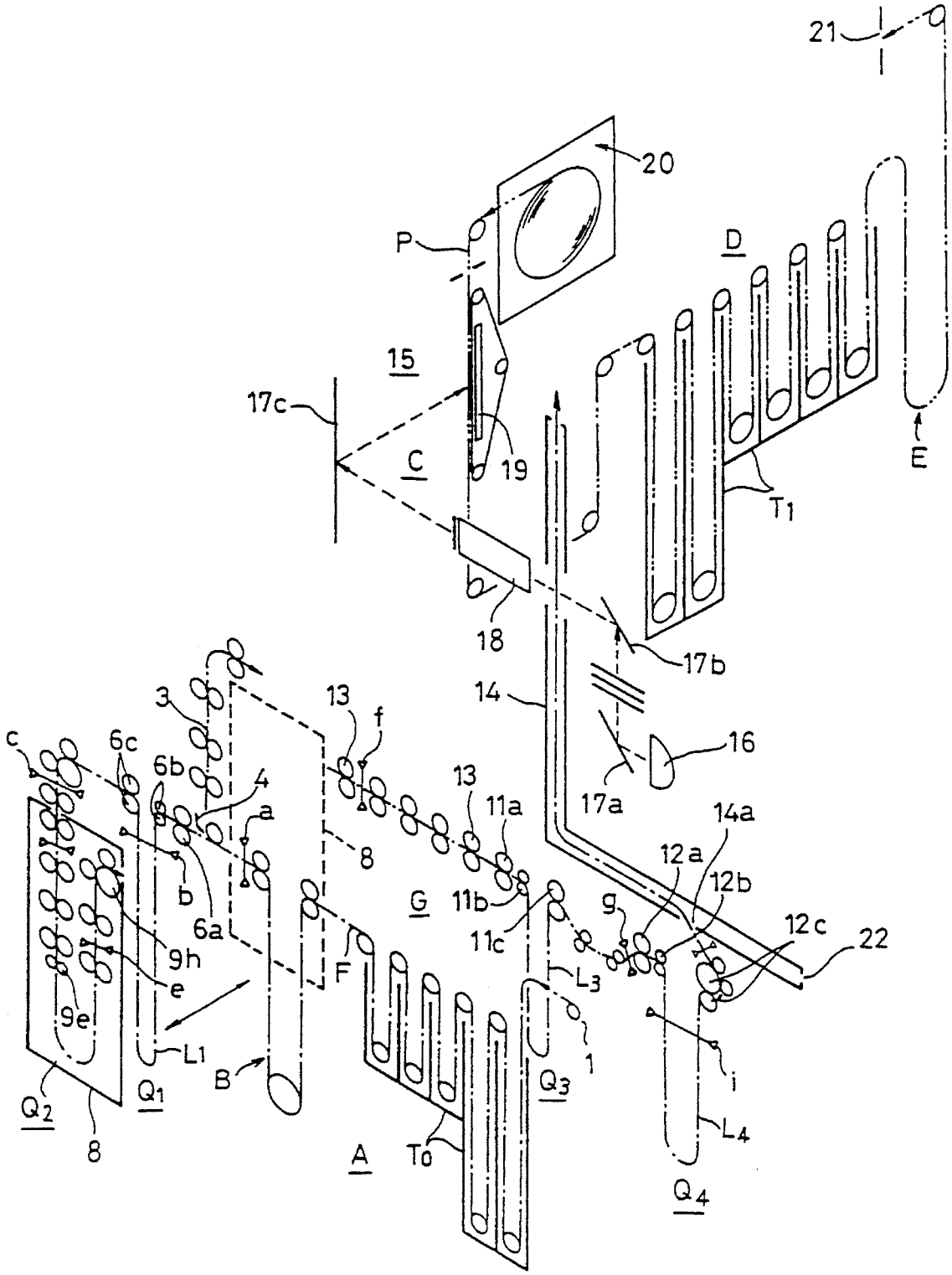
FIG. 5 is a schematic perspective view of the same.

FIGS. 1–8 show one embodiment of this invention. FIG. 5 schematically shows this embodiment. A film F is fed manually into the film developing unit A through its film inlet 1. It is then automatically developed by being fed through treating solutions in a plurality of treating tanks $T_0$. The film F thus developed is fed into the film drying unit B and dried. After drying, it is fed toward a first film stocking unit Q1.

Figure 2:
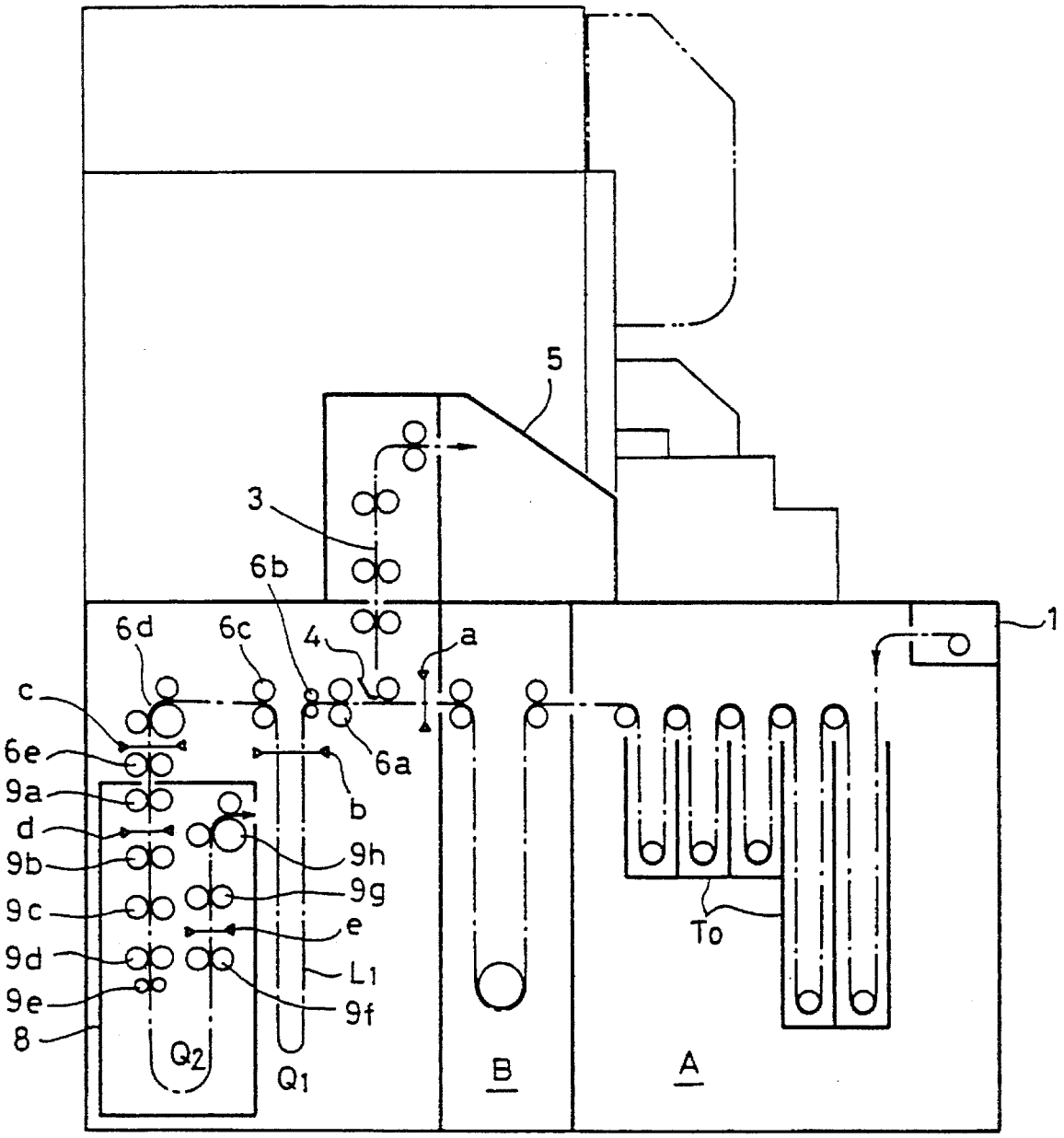
FIG. 2 is a sectional view taken along line I—I of FIG. 1.
Figure 6:
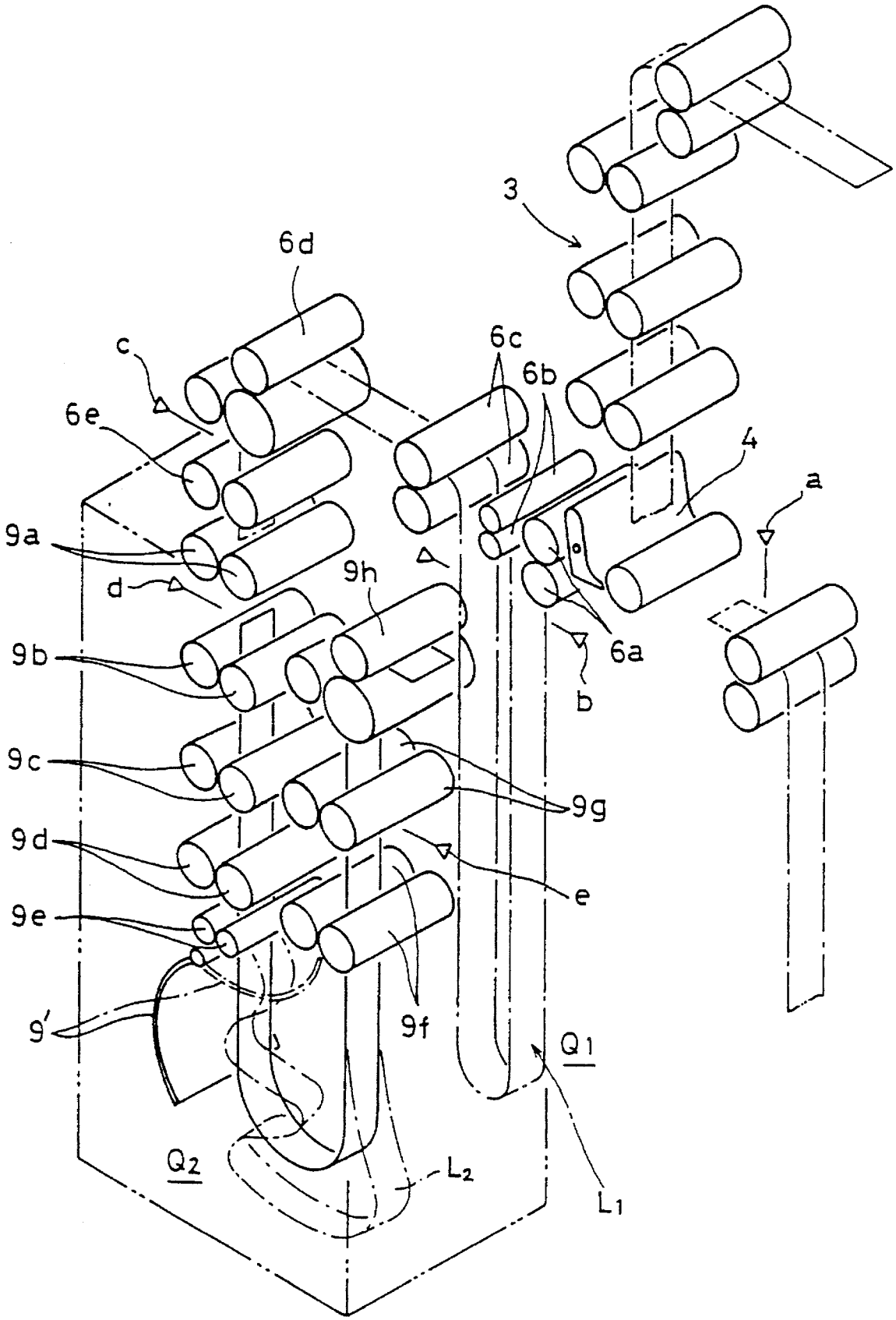

Upstream of the film stocking unit Q1 is a changeover guide 4 for changing over the feed direction toward a film discharge route 3 (see FIGS. 5–7). The changeover guide 4 is normally urged downward about a pivot center 4c by a spring 4a as shown in FIG. 7A so that its free end is located along the feed path of the film F. The film F is thus fed into the film discharge route 3 and then into a film stocker 5 (FIG. 2). Films are fed in this direction when films are only to be developed or if any unit in the later stage such as the first film stocking unit Q1 should fail. Films can be discharged manually from the film developing unit A through the changeover guide 4 into the film stocker 5 in case of e.g. power failure.

On the other hand, when developing and then printing films, the changeover guide 4 is turned by a solenoid 4b as shown in FIG. 7B as soon as the leading end of film F is detected by a sensor a located immediately before the guide 4 so that its free end gets out of the film feed path. The film F is thus fed straight ahead to the first film stocking unit Q1.

The first film stocking unit Q1 has a plurality of pairs of feed rollers that are arranged in one direction. The film F is fed in one direction or forms a loop L1 by turning or stopping the feed rollers 6a, 6c.

Namely, as shown in FIGS. 5 and 6, after passing through the changeover guide 4, the film F is fed straight ahead by the feed rollers 6a and 6c and then turned downwards by a feed roller 6d. After its leading end has been detected by a sensor c, the film is further fed a predetermined distance. When the film leading end is caught between the feed rollers 6e, the feed rollers 6c and 6d are stopped. On the other hand, the feed rollers 6a keep rotating, feeding the film F ahead. Thus, the loop L1 is formed. Even after the rear end of the film F has passed by the feed rollers 6a, the film is still held between the free press rollers 6b. The loop L1 is thus maintained. The rollers are driven by a pulse motor.

When the second film stocking unit Q2 is in a predetermined position (shown by solid line in FIG. 5), the feed rollers 6c, 6d and 6e begin turning when the sensor a detects the rear end of the film F or when the sensor b confirms the loop L1. The film F is thus fed into the second film stocking unit Q2. On the other hand, if the unit Q2 is not in the predetermined position, the loop L1 is formed and maintained. In this state, when the second film stocking unit Q2 moves to the predetermined position, the film F is fed thereto.

As shown in FIGS. 6 and 8, the second film stocking unit Q2 is mounted in a casing 8 movable along lateral rails 7. The film F which has been sent from the first film stocking unit Q1 is fed into the second film stocking unit Q2 through an inlet 8a formed in the top surface thereof. A loop L2 is formed by controlling feed rollers 9a, 9b . . . .

Namely, feed rollers 9a, 9b, 9c and 9d are driven by a single common pulse motor, while feed rollers 9f, 9g and 9h are driven by another pulse motor. When a guide plate 9'is in the position shown by chain line, the film F fed through the inlet 8a is run along a U-shaped path by synchronously driving the feed rollers 9a . . . 9h. When a sensor e detects the leading end of the film, the rollers 9f–9h are stopped for a predetermined time period, while the guide plate 9' moves back to the position shown by solid line. The film F is looped at L2 in the casing 8 with its leading end turned forwardly by the feed roller 9h. The formation of the loop L2 is completed when the rear end of the film F is caught between the idling press rollers 9e. On the other hand, the sensor d checks whether the film F has been completely pulled into the casing 8. The feed rollers 9a–9d are then stopped.

When one film F has been fed into the second film stocking unit Q2, the casing 8 is moved laterally by a pulse motor 10 through a belt 10a to the position shown by chain line of FIG. 8 and stopped. The casing 8 is moved and stopped by controlling the number of pulses supplied to the motor 10.

In the position shown by chain line of FIG. 5, the casing 8 is aligned with a straight feed unit G that runs parallel to the film F feed path in the film developing unit A. Thus, the film stocked in the second film stocking unit Q2 is fed out through its outlet 8b formed in the front side thereof toward the straight feed unit G. From the unit G, the film F is fed to third and then fourth film stocking units Q3 and Q4.

Figure 3:
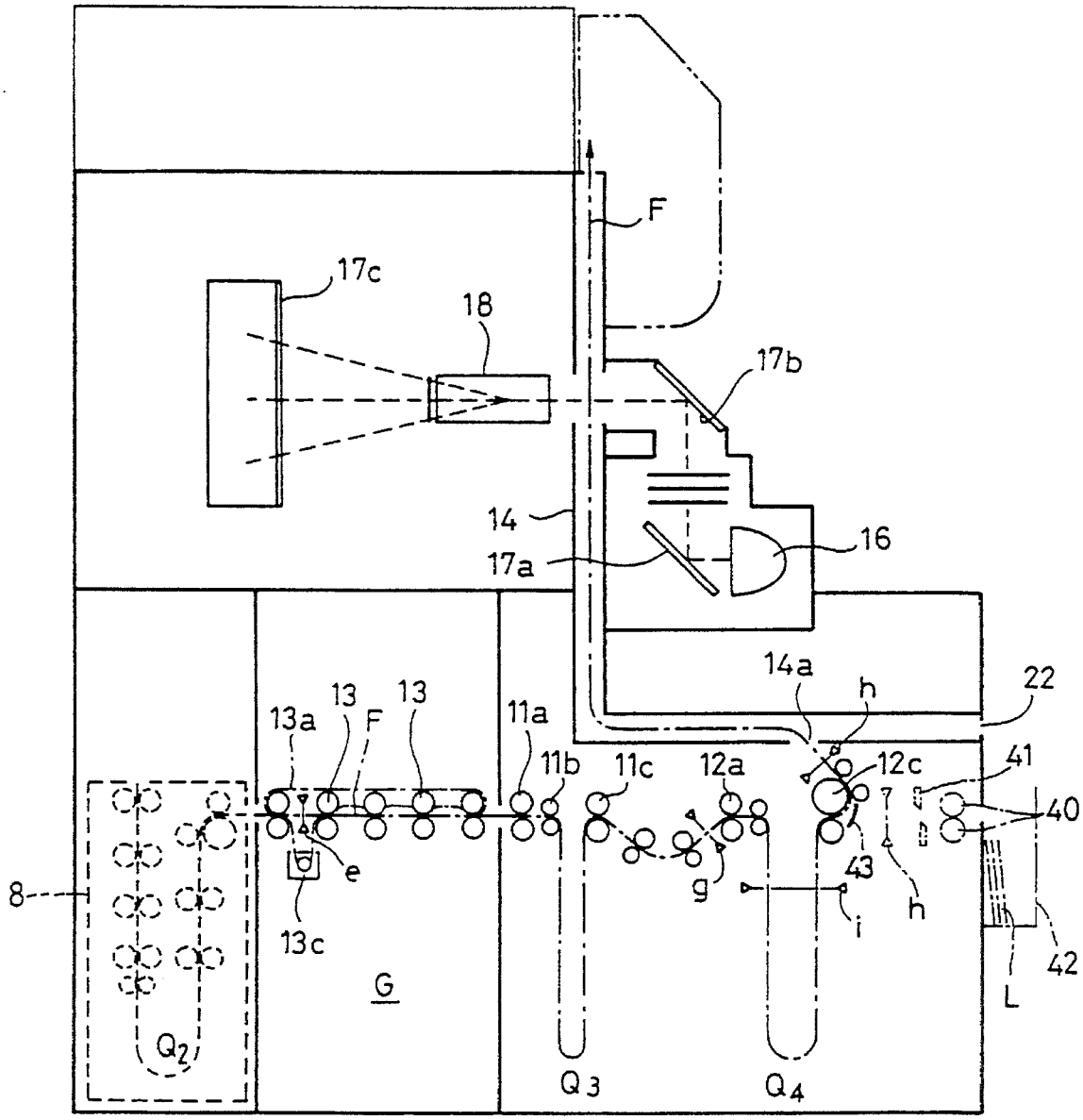
FIG. 3 is a sectional view taken along line II—II of FIG. 1.
Figure 4:
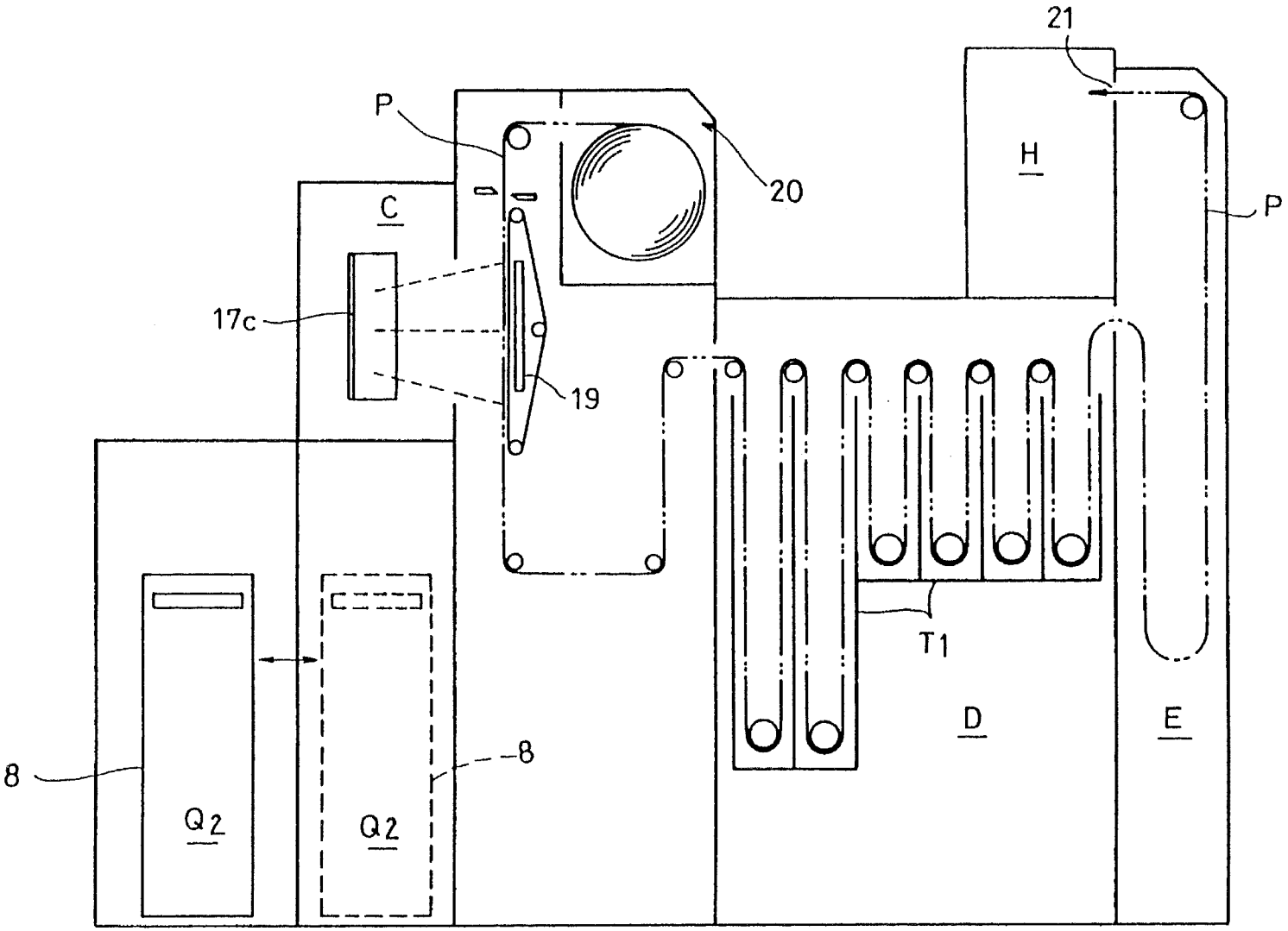
FIG. 4 is a sectional view taken along line III—III of FIG. 1.

The film F in the second film stocking unit Q2 is fed out by means of feed rollers 9f–9h. When a sensor f detects the rear end of the film F, the casing 8 is moved back to the position behind the first film stocking unit Q1 (the position shown by solid line of FIG. 5). The straight feed unit G has a plurality of feed rollers 13 and a belt 13a wound therearound. The film F is fed by rotating the feed rollers 13 by a pulse motor 13c through the belt 13a (FIG. 3).

The third and fourth film stocking units Q3, Q4 have rollers 11a–11c and 12a–12c and sensors g, h and i which are similar to those of the first film stocking unit Q1 to stock films F therein. If no film F is stocked in the fourth film stocking unit Q4, a film being fed into the third film stocking unit Q3 is not stocked in the unit Q3 but fed toward the fourth film stocking unit Q4.

Namely, the sensor i, which is similar to the sensor b, detects whether or not there is a loop L4 in the fourth film stocking unit Q4. If not, the feed rollers 11c keep rotating, so that the film F is fed into the fourth film stocking unit Q4 without forming a loop L3 in the unit Q3. On the other hand, if the loop L4 is detected, after the leading end of the film F is detected by the sensor g, the feed rollers 11c are stopped and caught between the feed rollers 12a. A loop L3 is thus formed in the unit Q3 because the feed rollers 11a keep rotating.

When all the frames of the film F in the printing unit C are printed, this film F is discharged. Then, the film F stocked in the fourth film stocking unit Q4 is fed toward the exposure unit 15 through the negative mask 14 by the feed roller 12c, which is located behind the unit Q4.

In the exposure unit 15, the light from a light source 16 is emitted through two mirrors 17a, 17b against the film F fed into the exposure unit 15. The images on the film F are enlarged by a printing lens 18 and printed through a mirror 17c on photographic paper P pulled out onto an exposure table 19.

The photographic paper P is stored in a magazine 20 in the form of a roll and pulled out onto the exposure table 19. After printing, the paper P is developed by being fed through various treating solutions in a plurality of treating tanks T1 in the developing unit D. The paper thus developed is then fed through the drying unit E and sent out through a discharge port 21 into a sorter H.

Besides the film inlet 14a, the negative mask 14 has another film inlet 22 for inserting films for extra printing or make-over. Film F fed through the inlet 22 is processed in the printing unit C in exactly the same way as the films fed through the inlet 14a. Namely, their images are printed onto photographic paper P, which is subsequently developed and dried.

When a film F is fed into the negative mask 14 through its inlet 22 while processing films fed through the inlet 14a, after discharging the film F in the printing unit C, the film in the fourth film stocking unit Q4 is not fed toward the printing unit C but stored in the unit Q4 in the form of a loop L4. In this state, the developed film F fed into the third film stocking unit Q3 will not be sent to the unit Q4 but be kept in the unit Q3 in the form of a loop L3. If the loop L3 is already formed in the unit Q2, the film F is stocked in the unit Q2 in the form of a loop L2. If the loop L2 is already formed in the unit Q2, the film F is stocked in the unit Q1 in the form of a loop L1. Thus, extra printing and make-over steps can be carried out without affecting the ordinary steps for developing and drying films.

Printing processes are carried out continuously thereafter. If the developing becomes not continuously but intermittent, irrespective of the length of interval, the portions of the film F in the film stocking units Q1–Q4 are fed one after another to the printing unit for printing.

If the film F requiring a rather long time for exposure is in the printing unit C, the following film is stored in the fourth film stocking unit Q4. If a loop is already formed in the unit Q4, films are stocked in the form of loops in the film stocking units Q3, Q2 and then Q1 in the manner as described above.

In the above embodiment, the film feed path are divided into two parts that extend parallel to each other in a single plane by providing the movable second film stocking unit Q2. Thus, in spite of the fact that there are provided a plurality of film stocking units Q1–Q4, the entire device is not very large because the film feed path is not a straight path (FIG. 19).

In case of a single film stocking unit Q as in the conventional arrangement, it can be moved to the printer from the film processor even if the film feed direction in the film processor is different from that in the printer, that is, they are not in the same vertical plane. This is possible if the film stocking unit Q has the same arrangement as the aforementioned second film stocking unit Q2 as shown in FIG. 9.

If the straight carrier unit G extending to the printing unit C does not run parallel to the film feed path in the film developing unit A (film processor) but is inclined by a certain angle, the film feed direction from the second film stocking unit Q2 can be aligned with the straight carrier unit G by pivoting the second film stocking unit Q2 (casing 8). Namely, by adequately moving straight and/or pivoting the second film stocking unit Q2, the film s can be automatically transferred even if the film carrier direction (film feed direction) of the film processor is at an angle with respect to that of the printer. It is extremely advantageous in manufacturing the photographic processing device of the present invention that the film feed directions in the film processor and the printer can be freely selected.

In this embodiment in which a leader is attached to the film F, even with a single film stocking unit Q, the film can be fed to the printer from the film processor even if the film feed direction in the film processor is inclined by any angle to that in the printer. This is possible if the film stocking unit Q has the same arrangement as the film stocking unit Q2 as shown in FIG. 16. Of course, the film feed directions in the film processor and the printer may not be parallel even if a plurality of the film stocking units are provided. They may be arranged in any angle.

FIGS. 10–16 show another embodiment. In this embodiment, a leader L is attached to each film F as shown in FIG. 17. This embodiment differs from the previous embodiment in the structure of the movable film stocking unit Q2 and in that a leader separating means R is provided (see chain lines in FIGS. 1 and 3).

Figure 1:
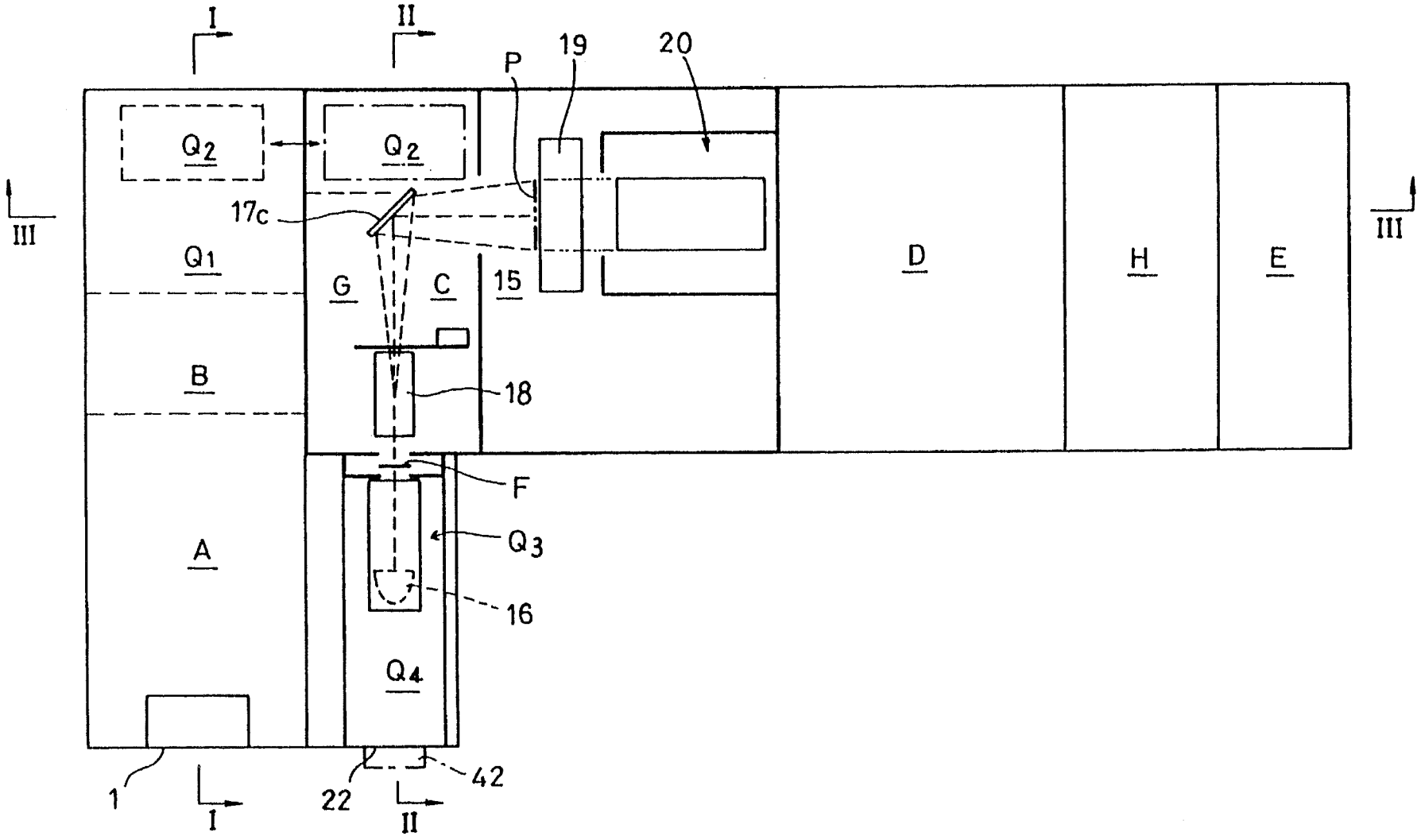
FIG. 1 is a plan view of one embodiment.

Similar to the first embodiment, the second film stocking unit Q2 has a plurality of feed rollers 9*a* . . . 9*h* in the casing 8 as shown in FIGS. 11 and 1.2 Some of these rollers 9*a* . . . are hourglass-shaped with the central portions cut away as shown in the figures. Since films F are fed through such central cut-away portions, they hardly touch these hourglass-shaped rollers. Since the leader L is wider than the cut-away portions, it is fed sandwiched between the feed rollers 9*a* . . . Predetermined ones of the other feed rollers 13, 12*a*, 11*a*, . . . in this embodiment are also hourglass-shaped with their central portions cut away.

Though not shown in FIG. 12, cylindrical auxiliary rollers 90 and film guides 90*b* are provided in the casing 8 as shown in FIG. 12. As shown in FIG. 14A, each film guide 90*b* is pivotally mounted on a support shaft 90*c* secured to a base e.g. the casing 8. Normally, the guides 90*b* are urged to the position shown by solid lines in FIG. 12 by springs 90*d* to guide the film F as shown in FIG. 14A. Upon contact with the leader L, they are swung back as shown by chain lines in FIG. 12, allowing the passage of the leader to pass.

The casing 8 is moved by a pulse motor 10 through a speed reducer 10*b* and a belt 10*a*. The casing 8 carries on its top two parallel detection plates 80*a* and 80*b*. Three sensors each 81*a*, 81*b* and 81*c* and 82*a*, 82*b* and 82*c* are provided along the respective travel paths of the detection plates 80*a* and 80*b*. While the detection plates 80*a*, 80*b* are passing through between the respective sensors 81*a* . . ., 82*a* . . . , they are turned off because the lights transmitted across the respective sensors are blocked by the detection plates 80*a*, 80*b*.

When the detection plates 80*a*, 80*b* move into between the first sensors 81*a*, 82*a*, blocking the lights transmitted thereacross, they are turned off. When the detection plates move further ahead and get into between the second sensors 81*b*, 82*b*, they are turned off. When slits 80*c*, 80*d* formed in the respective detection plates 80*a*, 80*b* are located between the first sensors 81*a*, 82*a*, the first sensors are turned on. In this position, i.e. the position in which the first sensors 81*a*, 82*a* are on and the second sensors 81*b*, 82*b* are off, the pulse motor 10 is stopped. The casing 8 is thus maintained in this position. If the casing 8 should overrun, thus turning the third sensors 81*c*, 82*c* off, the pulse motor 10 will be turned in reverse direction to move the casing 8 back until the first sensors 81*a*, 82*a*, which has been turned on and then off, is turned back on again (until the slits 80*c*, 80*d* move into between the first sensor again). Thus, the third sensors 81*c*, 82*c* detect the respective ends of the casing 8.

As shown in FIGS. 13–15, the leader separating means R comprises a cutter 41 made up of upper and lower blades 41*a*, 41*b*, a leader stocker 42 and a guide 43. A film F having a leader L which has been attached thereto is fed until its end protrudes from delivery rollers 40 as shown in FIGS. 10 and 12A and then cut by the cutter 41 as shown in FIG. 15B to separate the leader L from the film. The cutter 41 is activated when the feed rollers 12*c* have turned a predetermined time period after detecting the leader L by the sensor h. The leader L thus cut apart is fed by the delivery rollers 40 and dropped into the leader stocker 42.

Figure 15A:
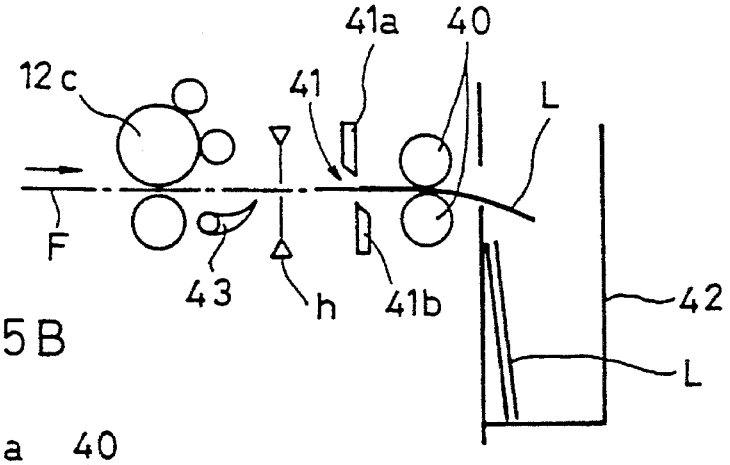
Figure 15B:
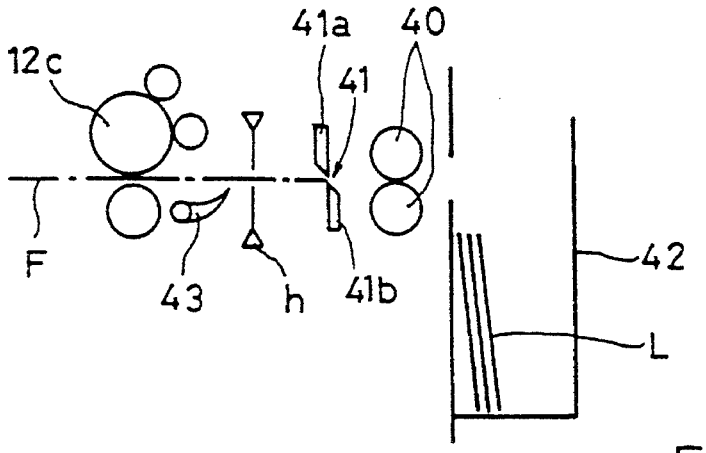
Figure 15C:
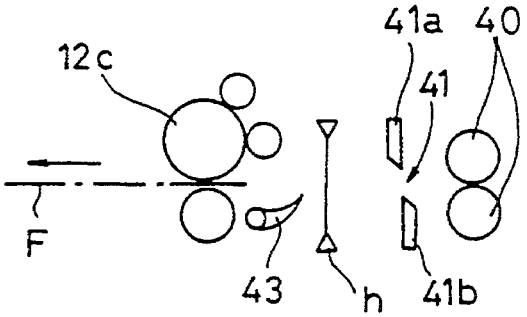
Figure 15D:
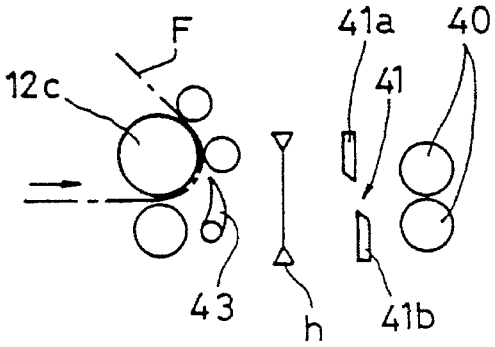

The guide 43, provided near the feed rollers 12*c*, is kept out of the film feed path, allowing smooth feed of the leader L (film F). When the leader L is cut apart and dropped into the leader stocker 42, the feed rollers 12*c* turn in reverse, rewinding the film F to the position shown in FIG. 15C. The guide 43 is erected in this state as shown in FIG. 15D. Then, the film F is fed forward again and turned upwards by the guide 43. The guide 43 is moved out of the film feed path by a rotary solenoid provided coaxially with the shaft of the guide 43 and returned to the erect position by a spring 43*a*. The delivery rollers 40 and feed rollers 12*c* are driven by a pulse motor 50*a*, while the feed rollers 12*a* are driven by a pulse motor 50*b*.

In FIG. 13, numeral 48 indicates a film guide for bending the film F downwards. As shown in FIG. 14B, it is pivotally mounted on a guide roller 12*d*. Normally, it is kept in the position shown by solid line in FIG. 13 by a spring 48*a*. When the leader L is inserted under the film guide 48 as shown by two-dot chain line in FIG. 14B, the film guide 48 is raised to the position shown by chain line in FIG. 13. When the film F is subsequently inserted under the film guide 48 as shown by chain line in FIG. 14B, the film guide 48 will return to the position shown by solid line in FIG. 13 because the film is narrower than the leader L. The film F is thus bent downwards. Thus, by feeding the film by the feed rollers 12*a*, the loop L4 as shown by chain line in FIG. 13 can be formed smoothly. Similar film guides 48 should be provided in the other film stocking units Q1 . . . .

similar to the first embodiment, when all the frames on the film F in the film printing unit C have been printed, the film will be discharged and the feed roller 12*c*, which is located behind the fourth film stocking unit Q4, feeds the film F kept in the unit Q4 (with its leading end turned upwards as shown in FIG. 15D) to the exposure unit 15 through the negative mask 14. The images on the film F are then printed onto photographic paper.

Also, as shown in FIGS. 16 and 17 (chain lines indicate the leader separating means R), the abovementioned advantages are achievable when additional film stocking units Q are provided behind the film stocking units Q in the device shown in FIGS. 18 and 19. Instead of providing two each feed rollers 11*a*, 11*c* and 12*a*, 12*c* between the third and fourth film stocking units Q3 and Q4, one pair of rollers 11*c* and 12*a* may be commonly used for both units Q3 and Q4. Namely, each of the units Q3 and Q4 may comprise two feed rollers 30*a* and 30*c*. In the figures, numerals 30*b* and 31*b* indicate free press rollers and s indicates a sensor. In the embodiments shown in these figures, the straight feed unit G is in a vertical plane that contains the film developing unit A and the film drying unit B.

In the above embodiments, the straight feed unit G is used simply to feed films. But this portion may be also used as an extra film stocking unit by providing a sensor similar to those provided in the other film stocking unit and replacing the feed rollers 13 with ones which can be selectively turned on and off. With this arrangement, it is possible to stock a film in the feed unit G by temporarily stopping the feed of the film and also stopping the feed of the film in the second film stocking unit Q2.

In any of the embodiments, the number of film stock units and their positions are not limited. For example, an extra film stocking unit may be provided in the straight film feed path G.

What is claimed is:

1. A photographic processing machine comprising a film developing unit, a film drying unit, a printing unit, a photographic paper developing unit and a photographic paper drying unit, wherein a film is fed through the film developing unit and the film drying unit to develop and dry the film, and wherein photographic paper is fed through the printing unit, photographic paper developing unit and photographic paper drying unit to print images on the film onto the photographic paper and to develop and dry the photographic paper, characterized in that said film developing unit and said film drying unit are arranged along a straight line from a film inlet formed in said film developing unit, a film feed path extending to said printing unit is provided in a different direction from said straight line that extends through said film developing unit and said film drying unit, and that a film stocking unit is provided downstream of said film drying unit, said film stocking unit being movable to a position aligned with said film feed path extending to said printing unit.

2. A photographic processing machine comprising a film developing unit, a film drying unit, a printing unit, a photographic paper developing unit and a photographic paper drying unit, wherein a film having a leader attached to the leading end thereof is fed through the film developing unit and the film drying unit to develop and dry the film, and wherein photographic paper is fed through the printing unit, photographic paper developing unit and photographic paper drying unit to print images on the film onto the photographic paper and to develop and dry the photographic paper, characterized in that said film developing unit and said film drying unit are arranged along a straight line from a film inlet formed in said film developing unit, a film feed path extending to said printing unit is provided in a different direction from said straight line that extends through said film developing unit and said film drying unit, that a film stocking unit is provided downstream of said film drying unit, said film stocking unit being movable to a position aligned with said film feed path extending to said printing unit, and that said device further comprises means for separating the leader from the film, said means being provided upstream of said printing unit.

* * * * *